US011930873B2

(12) United States Patent
Hodgdon et al.

(10) Patent No.: US 11,930,873 B2
(45) Date of Patent: Mar. 19, 2024

(54) HEADWEAR WITH ANCHOR POINTS

(71) Applicant: Sunday Afternoons, Inc., Talent, OR (US)

(72) Inventors: Russell R. Hodgdon, Talent, OR (US); James Stinson, Eugene, OR (US); Joey Fallon, Ashland, OR (US)

(73) Assignee: SUNDAY AFTERNOONS, INC., Talent, OR (US)

( * ) Notice: Subject to any disclaimer, the term of this patent is extended or adjusted under 35 U.S.C. 154(b) by 41 days.

(21) Appl. No.: 17/660,390

(22) Filed: Apr. 22, 2022

(65) Prior Publication Data

US 2022/0346482 A1 Nov. 3, 2022

Related U.S. Application Data

(60) Provisional application No. 63/182,600, filed on Apr. 30, 2021.

(51) Int. Cl.
*A42B 1/045* (2021.01)
*A42B 1/0186* (2021.01)

(52) U.S. Cl.
CPC ..... *A42B 1/045* (2013.01); *A42B 1/0186* (2021.01)

(58) Field of Classification Search
CPC ..... A41B 1/045; A41B 1/0186; A41B 1/0187
See application file for complete search history.

(56) References Cited

U.S. PATENT DOCUMENTS 33,386 A * 10/1861 Gittens, Jr. ..... A42B 1/0186 2/172
480,041 A * 8/1892 Schlesinger ..... A42B 7/00 2/175.5
2,462,679 A * 2/1949 Rosenau ..... A42B 1/201 D2/870
2,686,917 A * 8/1954 Auerbach ..... A42B 1/0186 2/172
3,376,581 A * 4/1968 Gettinger ..... A42B 1/16 2/209.11
3,469,264 A * 9/1969 Harris ..... A42B 1/06 2/172

(Continued)

FOREIGN PATENT DOCUMENTS

KR 200458923 Y1 * 2/2012
KR 20120035692 A * 4/2012

(Continued)

OTHER PUBLICATIONS

Translation of KR1020120035692, Apr. 16, 2012, translated via Espacenet (Year: 2012).*

(Continued)

*Primary Examiner* — Heather Mangine
(74) *Attorney, Agent, or Firm* — McCoy Russell LLP

(57) ABSTRACT

Embodiments for headwear are disclosed herein. In one embodiment, a headwear includes a crown, a chin strap coupled to the crown, the chin strap having a first strap portion and a second strap portion, and a set of fasteners to which one or more different components are configured to removably attach, the set of fasteners including a first fastener positioned on the first strap portion of the chin strap and a second fastener positioned on the second strap portion of the chin strap.

14 Claims, 11 Drawing Sheets

(56) References Cited

U.S. PATENT DOCUMENTS 3,855,634 A * 12/1974 Gregg ..... A42B 1/045 2/172
5,081,717 A * 1/1992 Shedd ..... A42B 1/0187 2/181.4
5,153,943 A * 10/1992 Clement ..... A42B 1/0187 2/418
5,649,327 A * 7/1997 Crewe ..... A42B 1/0187 2/172
5,657,490 A * 8/1997 Edmark ..... A42B 1/201 2/182.2
5,666,668 A * 9/1997 Ronquillo ..... A42B 1/06 2/172
5,694,647 A * 12/1997 Crickmore ..... A42B 1/0187 2/172
5,694,648 A * 12/1997 Nucifora ..... A42B 1/0186 2/172
D399,992 S * 10/1998 Edmark ..... D2/880
5,857,219 A * 1/1999 Edmark ..... A42B 1/201 2/182.2
5,860,165 A * 1/1999 Cvijanovich ..... A42B 1/0186 2/172
5,875,493 A * 3/1999 MacDonald ..... A42B 1/205 2/171.1
5,933,871 A * 8/1999 Kraft ..... A42B 1/24 2/209.13
5,950,241 A * 9/1999 Gomez ..... A42B 1/201 2/172
6,996,852 B1 * 2/2006 Cabrera ..... A42B 1/24 2/172
D594,185 S * 6/2009 Lacy ..... D2/879
9,655,396 B1 * 5/2017 Lacy ..... A42B 1/206
D841,944 S * 3/2019 Lacy ..... D2/879
D843,087 S * 3/2019 Foster ..... A42B 1/0181 D2/886
10,687,569 B1 6/2020 McDirmid
D912,945 S * 3/2021 Lacy ..... D2/879
D954,400 S * 6/2022 Lacy ..... D2/879
2006/0168709 A1 * 8/2006 Rattay ..... A42B 1/22 2/183
2008/0066214 A1 * 3/2008 O'Hare ..... A42B 1/241 2/243.1
2009/0064393 A1 * 3/2009 Lambertz ..... A42B 1/06 2/172
2011/0107500 A1 * 5/2011 Wathen ..... A42B 1/0187 2/209.13
2011/0145977 A1 * 6/2011 Oates ..... A42B 1/0187 2/175.1
2015/0059054 A1 * 3/2015 Peterson ..... A42B 1/0187 2/172
2015/0201693 A1 * 7/2015 Donner ..... A42B 1/048 2/204
2016/0021960 A1 1/2016 Lacy et al.
2016/0021962 A1 * 1/2016 Lacy ..... A42B 1/22 2/181
2016/0058089 A1 * 3/2016 Niedrich ..... A42B 1/0187 2/172
2018/0360150 A1 * 12/2018 Lybarger ..... A42B 1/0186
2020/0214382 A1 * 7/2020 Dann ..... A42B 1/225
2021/0100307 A1 * 4/2021 Sunseri ..... A42B 1/201
2021/0259345 A1 * 8/2021 Michaels ..... A42B 1/22
2021/0361015 A1 * 11/2021 Kountz ..... A42B 1/019
2022/0061443 A1 * 3/2022 Kountz ..... A42B 1/22
2022/0192303 A1 * 6/2022 Tezcucano Boy ... A42B 1/0195
2022/0256957 A1 * 8/2022 Nakamura ..... A42B 1/04
2022/0346482 A1 * 11/2022 Hodgdon ..... A42B 1/045
2023/0000193 A1 * 1/2023 Michaels ..... A42B 1/0187

FOREIGN PATENT DOCUMENTS

KR 101963301 B1 3/2019
WO 2012028743 A1 3/2012

OTHER PUBLICATIONS

Translation of KR200458923, Feb. 21, 2012, translated via Espacenet (Year: 2012).*
ISA Korean Intellectual Property Office, International Search Report and Written Opinion Issued in Application No. PCT/US2022/071902, dated Aug. 4, 2022, WIPO, 9 pages.

* cited by examiner

HEADWEAR WITH ANCHOR POINTS

CROSS-REFERENCE TO RELATED APPLICATIONS

The present application claims priority to U.S. Provisional Patent Application No. 63/182,600 entitled "HEADWEAR WITH ANCHOR POINTS ON CHIN STRAP" and filed Apr. 30, 2021, the entire contents of which is hereby incorporated by reference for all purposes.

FIELD

The present description relates generally to headwear or other accessories including a chin strap.

BACKGROUND

Headwear may be utilized to shield a wearer from environmental hazards, such as sunlight, debris, rain, etc. Full-brimmed hats (e.g., a hat having a brim that fully encircles the hat) may provide more protection from such hazards, but may be bulkier than other styles of hats, such as caps with visors. Further, depending on the angle of the sun, even full-brimmed hats may not provide a desired level of sun protection, particularly along the neck of a wearer. Thus, some hats are configured with rear/neck capes and/or side flaps that extend outward and/or downward from the crown of the hat, which may provide additional protection. However, during certain conditions, these capes and flaps may be distracting to a wearer or may be moved around by air movement, thereby negating their usefulness.

SUMMARY

The disclosure provides embodiments of a headwear including a crown, a chin strap coupled to the crown, and a set of fasteners to which one or more different components are configured to removably attach, the set of fasteners including a first fastener positioned on a first strap portion of the chin strap and a second fastener positioned on a second strap portion of the chin strap. In some examples, the one or more different components to which the set of fasteners are configured to removably attach include a rear cape extending downward from the crown, such that the first and second fasteners may be configured to couple to complementary fasteners on the rear cape.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
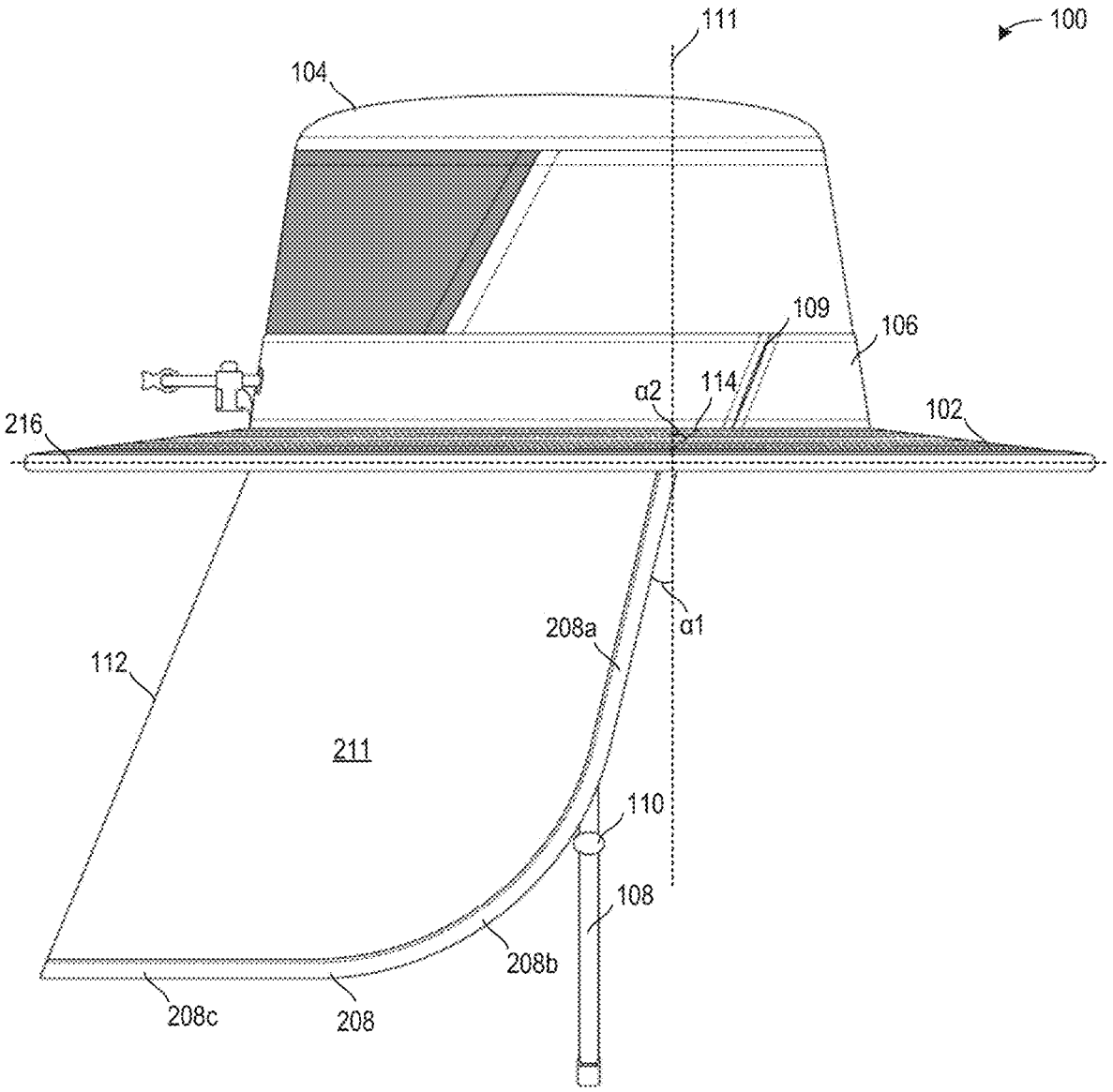
FIG. 1 shows a side view of an example headwear including a rear cape in accordance with one or more embodiments of the present disclosure.
Figure 2:
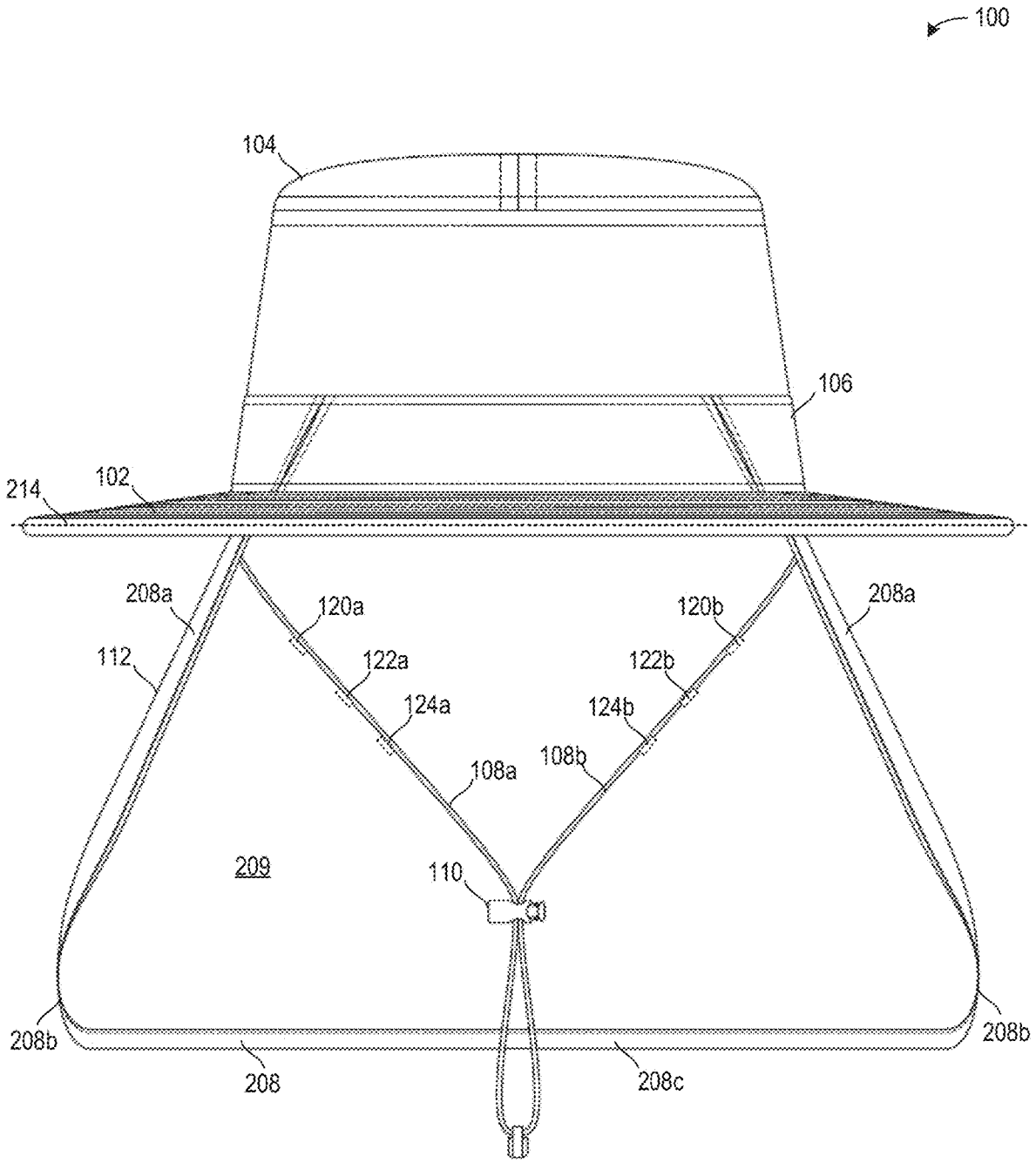
FIG. 2 shows a front view of the example headwear of FIG. 1 in accordance with one or more embodiments of the present disclosure.
Figure 3:
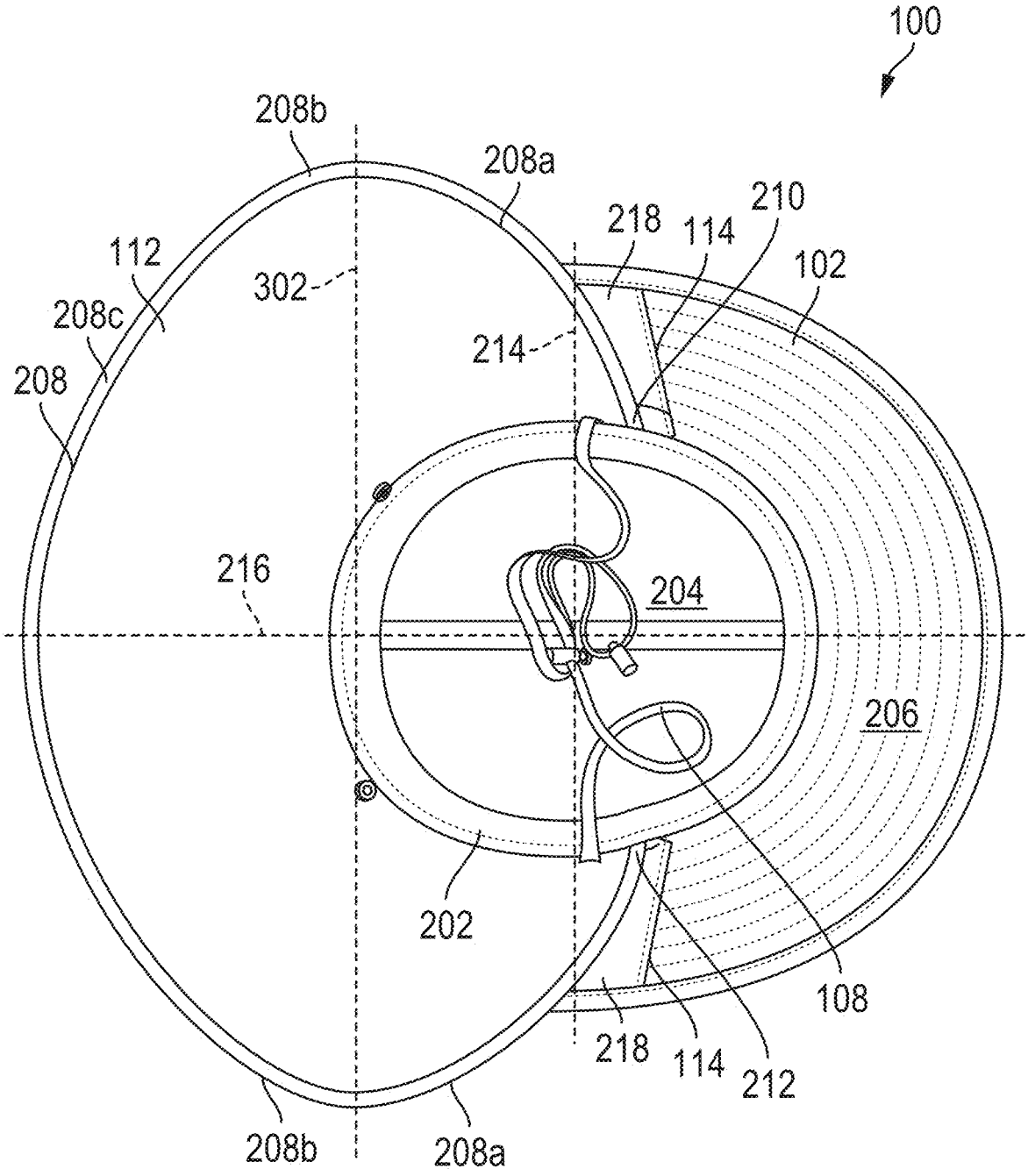
FIG. 3 shows an underside view of the example headwear of FIG. 1 in accordance with one or more embodiments of the present disclosure.
Figure 4:
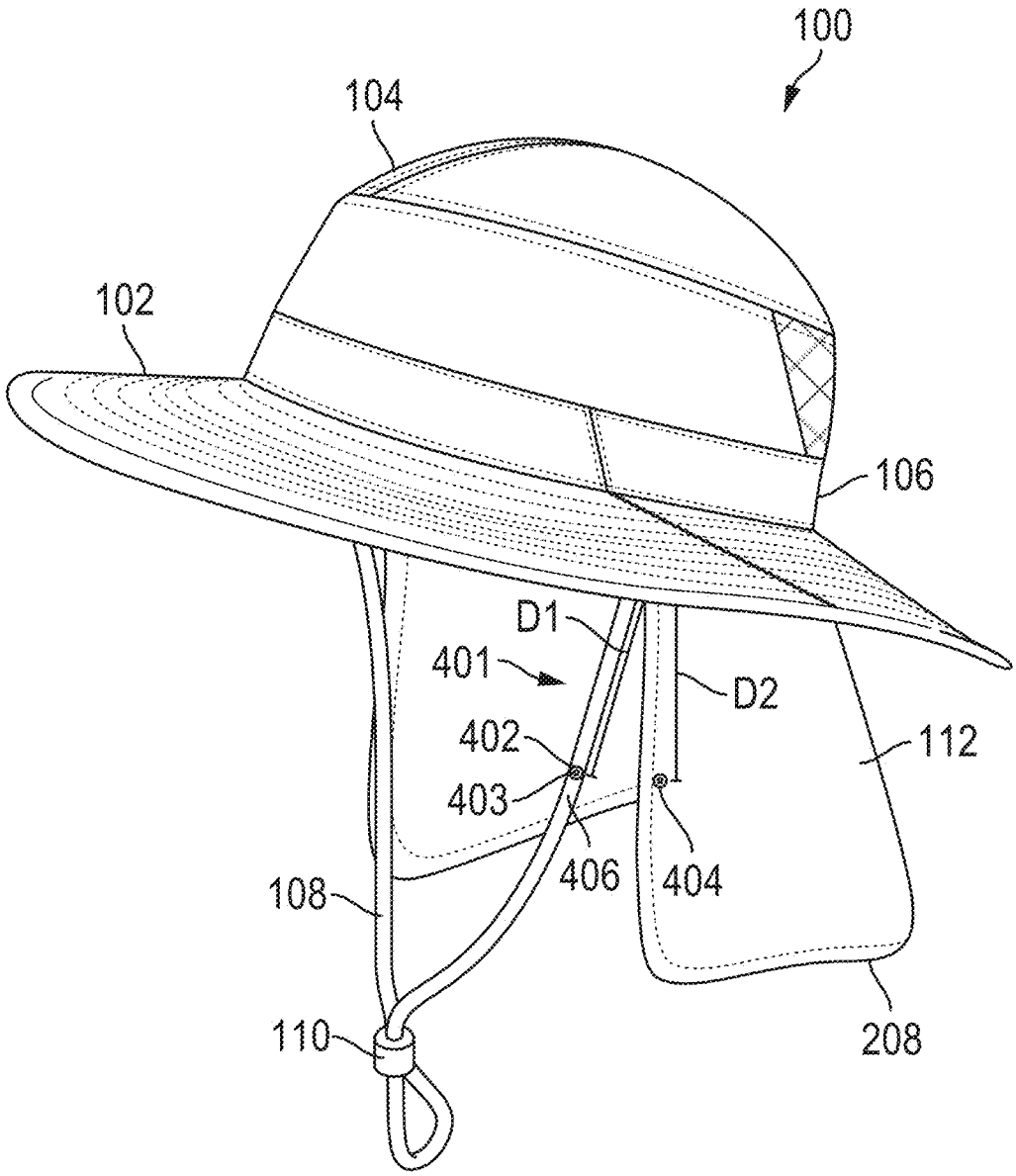
FIG. 4 shows a side view of an example headwear including fasteners for a rear cape and a chin strap.
Figure 7:
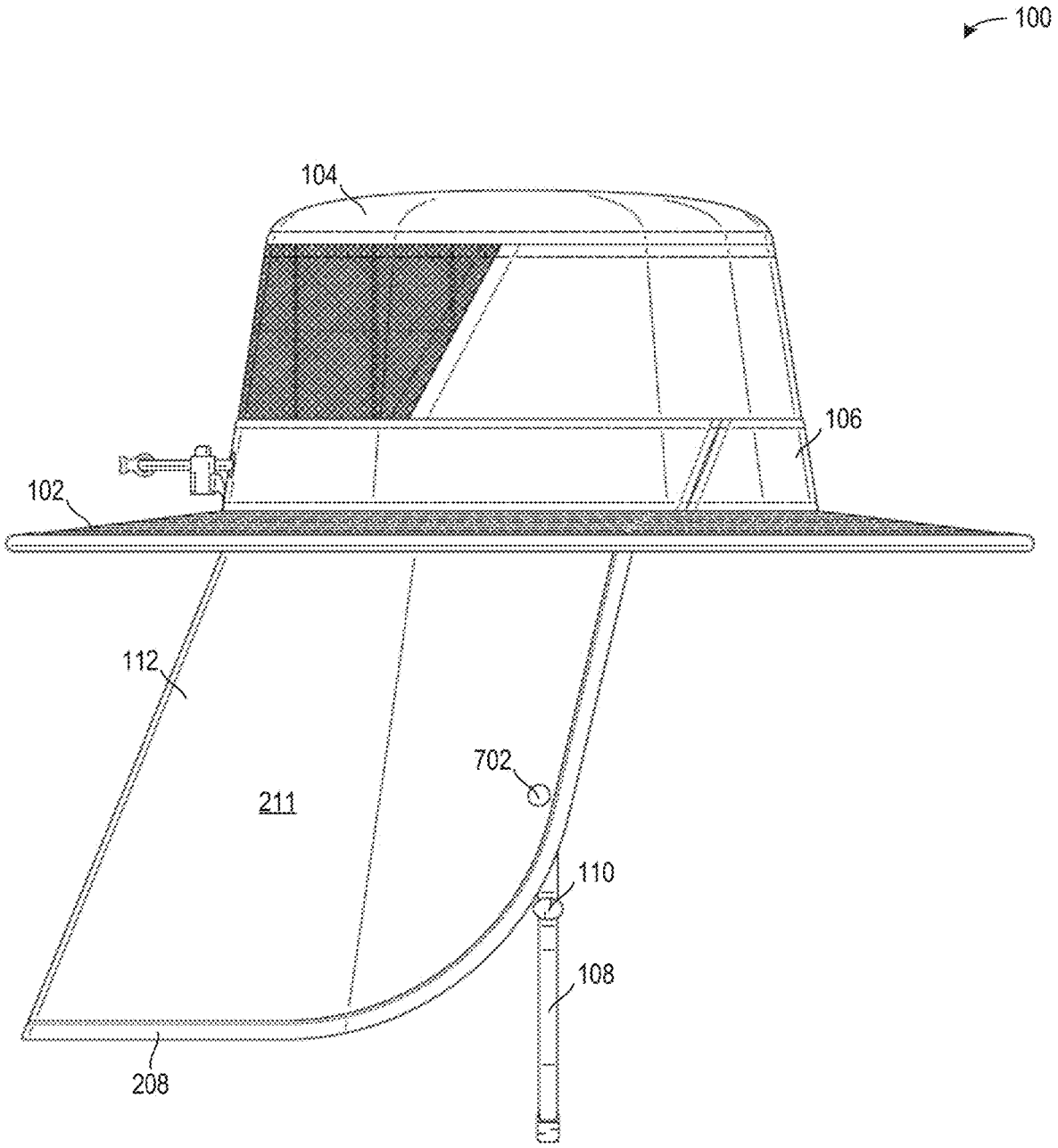
FIG. 7 shows a second side view of the example headwear of FIG. 4 in the unfastened state.
Figure 8:
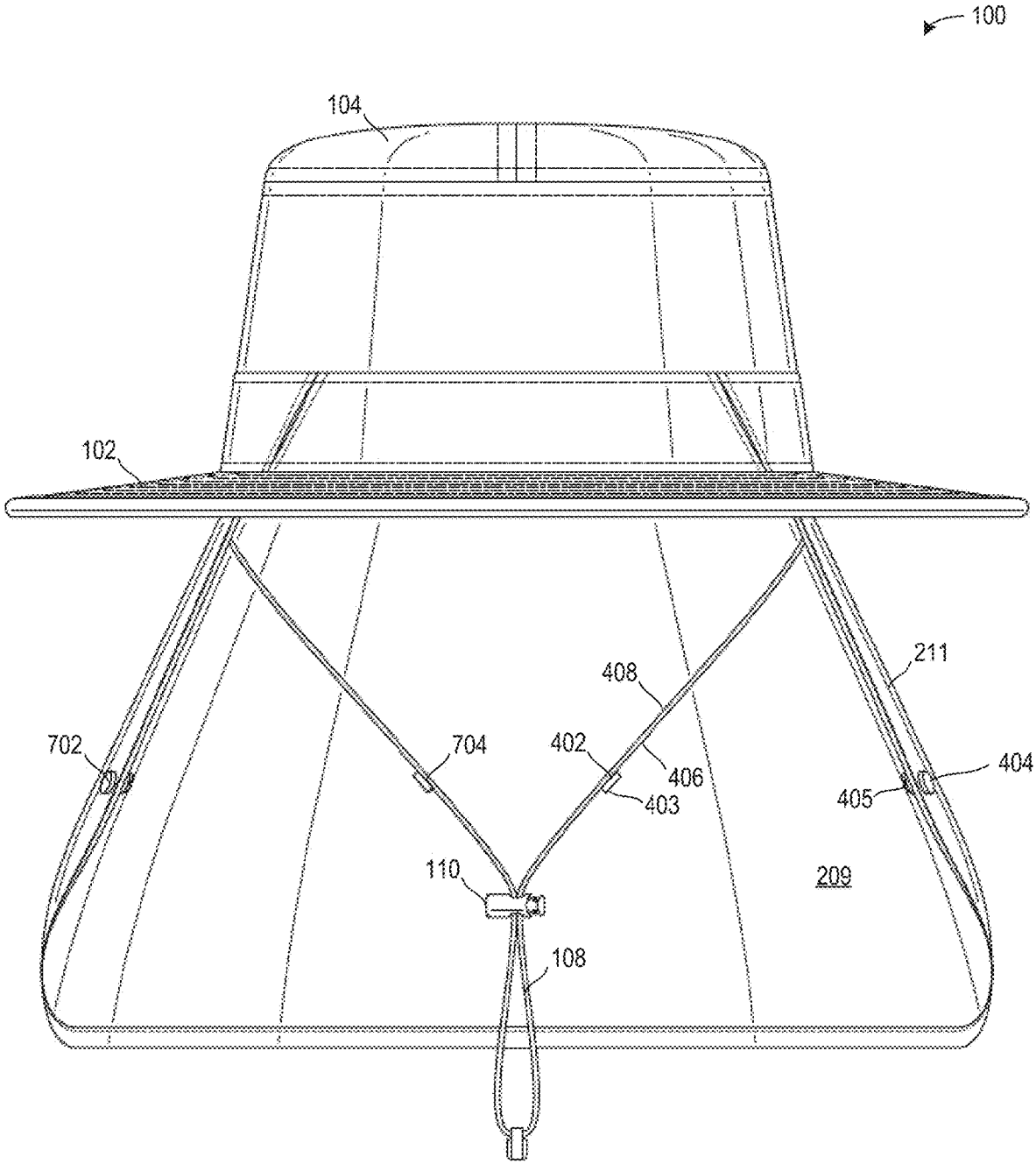
FIG. 8 shows a front view of the example headwear of FIG. 4 in the unfastened state.
Figure 9:
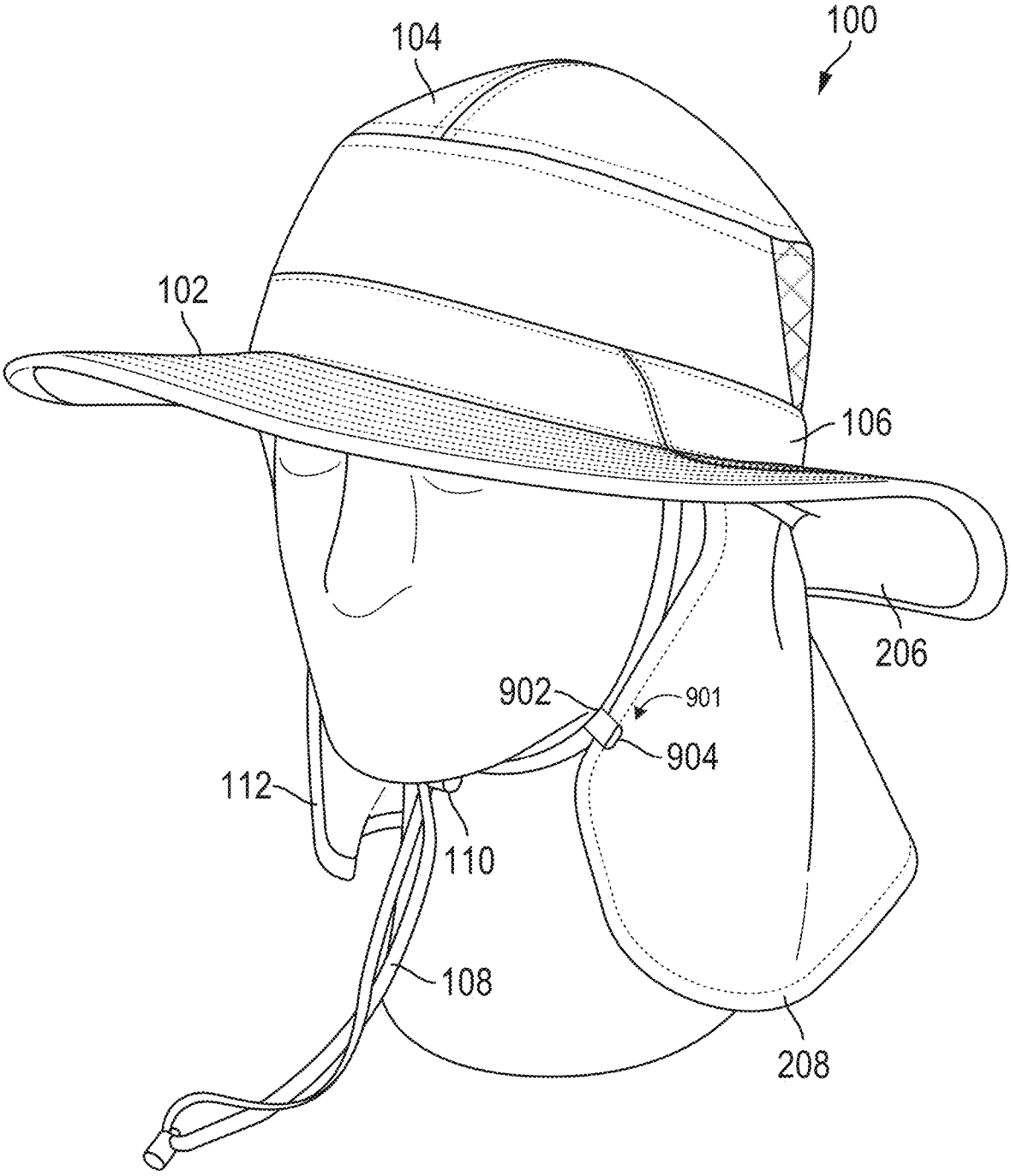
FIG. 9 shows a front view of another example headwear in a fastened state where fasteners on the rear cape hold the rear cape in place along the chin strap.
Figure 10:
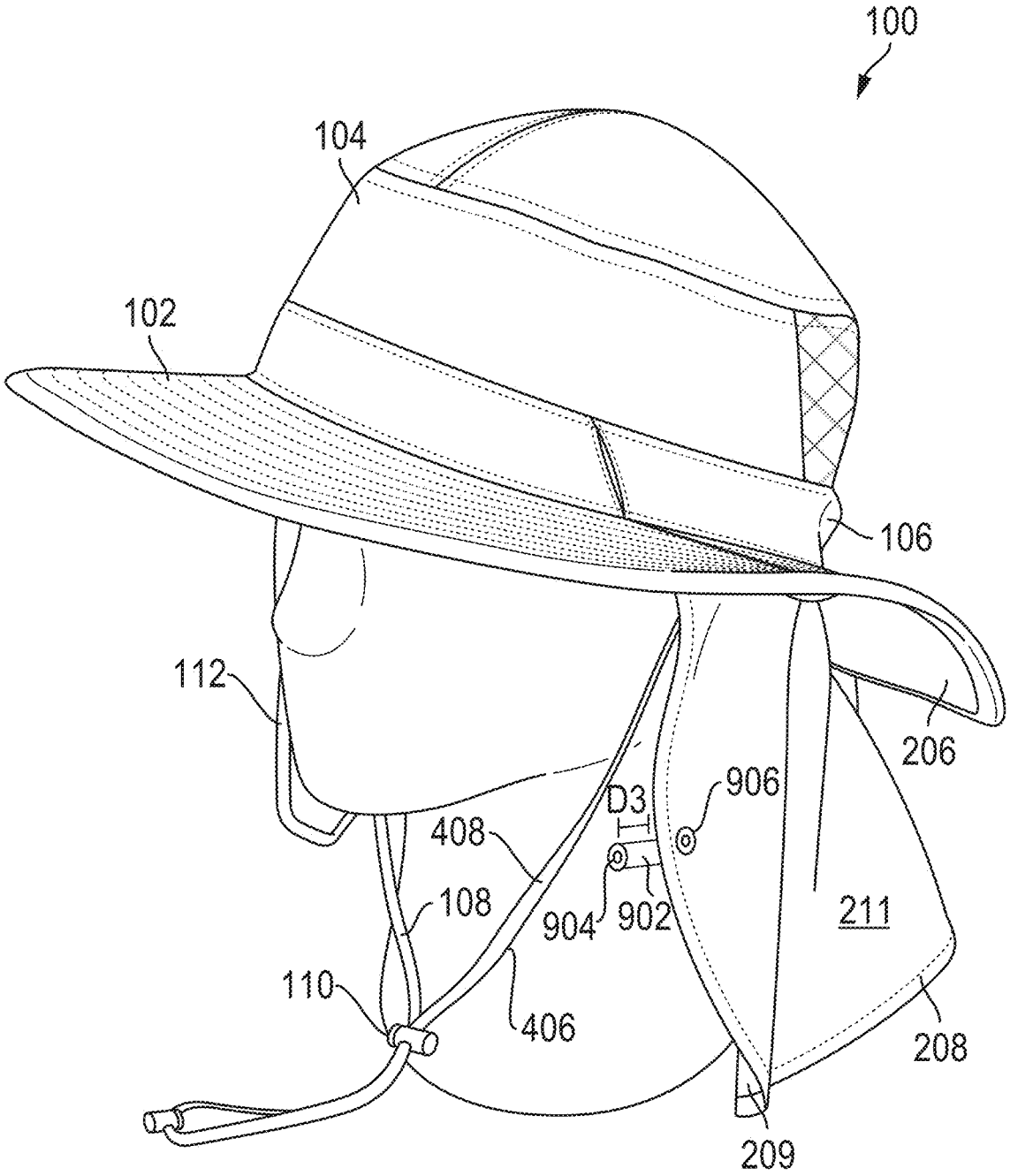
FIG. 10 shows a first side view of the example headwear of FIG. 9 in an unfastened state where the rear cape is not fastened to the chin strap.
Figure 11:
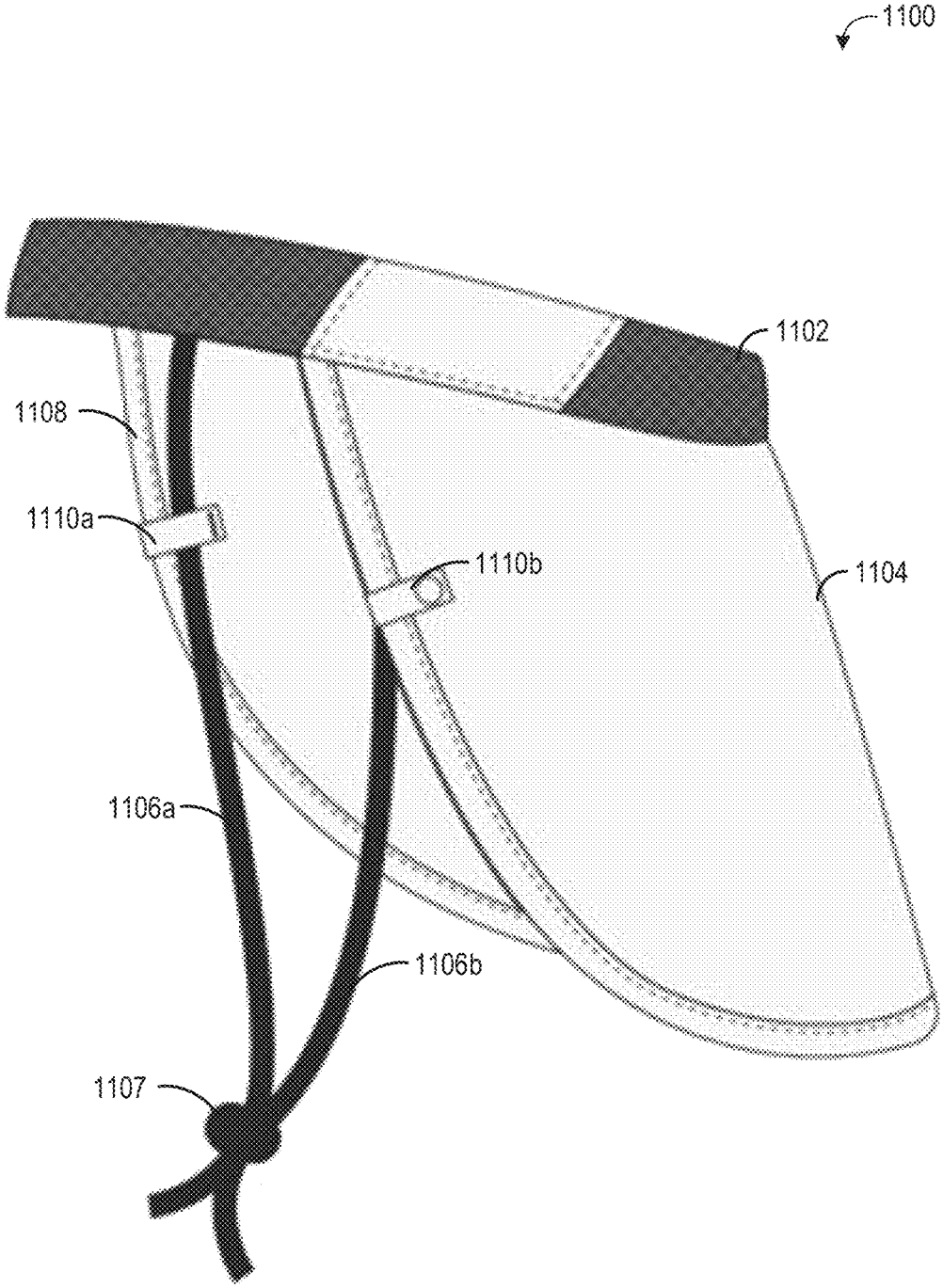
FIG. 11 shows a side view of another example headwear in a fastened state.

Examples of headwear including anchor points are provided herein. The anchor points described herein are configured to removably couple a tensionable chin strap of the headwear to one or more other components, such as a component of the headwear (e.g., a rear cape of the headwear) and/or components separate from the headwear, such as a mask, balaclava, etc. The anchor points may be positioned on the chin strap, on the rear cape (e.g., on leading edges of the rear cape), or on both the chin strap and the rear cape. The anchor points may comprise fasteners on the chin strap with complementary fasteners on the rear cape and/or other components, such as snaps, hook and loop fasteners, etc., or the anchor points may comprise loops or slits on or in the rear cape, though which the chin strap may be held in place along the rear cape. FIGS. 1-3 show an example headwear with anchor points on a chin strap of the headwear. FIGS. 4-8 show another example headwear with anchor points on a chin strap of the headwear and complementary anchor points on a rear cape of the headwear. FIGS. 9 and 10 show a further example headwear with anchor points on a rear cape of the headwear. FIG. 11 shows a still further example headwear with anchor points on a rear cape of the headwear.

FIG. 1 shows a side view of an example headwear, herein a hat 100. FIG. 2 shows a front view of the hat 100 and FIG. 3 shows an underside view of the hat 100, when the hat 100 is resting flat on a surface. FIGS. 1-3 will be described collectively. As illustrated, hat 100 includes a brim 102 and a crown 104. The brim 102 may be attached to, extend from, and/or otherwise be carried by the crown 104 (e.g., a bottom portion of the crown 104). As used herein, the term "crown" may include a portion of a headwear that extends at least partially over and/or around a head of a wearer. A full crown may fully cover the top of a wearer's head (e.g., as in caps, fedoras, beanies, boonies, and other full-crowned hats). A partial crown may not cover the top of a wearer's head (e.g., as in visors, headbands, or earbands). The crown may extend fully or partially around a circumference of the wearer's head at one or more locations of the wearer's head. A brim may include a portion of the headwear that extends outward from the crown. A full brim may extend around an entirety of the crown while a partial brim may extend only around one or more portions of the crown. Thus, a cap may include a full crown and a partial brim, a visor may include a partial crown and a partial brim, a boonie (e.g., as shown in FIGS. 1-3) may include a full crown and a full brim, while a headband (e.g., as shown in FIG. 11) may include a partial crown and no brim.

In the example shown in FIGS. 1-3, the crown may be a full crown configured to extend over a top of a wearer's head. However, the crown 104 may be a partial crown without departing from the scope of this disclosure. In some embodiments, the crown 104 may include a plurality of panels extending around a circumference of the crown and intersecting at a central region. In other embodiments the crown 104 may be formed of a single panel or piece of fabric (e.g., a unibody construction) forming any suitable hat body shape. In some embodiments, each panel (or the entirety of the crown) may include the same type of fabric or other material. In other embodiments, one or more panels (or the crown) may include a different type of material than the other panels.

As illustrated in FIG. 1, the crown 104 may include one or more external peripherals, such as band 106, which may serve aesthetic and/or utility purposes. For example, the band 106 may include an internal sweatband for moisture wicking purposes and/or the band 106 may accommodate a tightening mechanism, which may be adjusted to change a size of the crown. In still further examples, the band 106 may be omitted. While a tightening mechanism is shown in band 106, it is to be understood that hat 100 may include any other type of size-adjustment mechanism (e.g., snapback) or no size-adjustment mechanism. Crown 104 may further include slits 109 on opposing sides to accommodate eyewear or the like that the wearer may want to rest on the brim 102. In some examples, the crown may include multiple sets of slits 109 (e.g., to accommodate eyewear in multiple positions) or the slits may be omitted.

The hat 100 shown in FIGS. 1-3 includes the brim 102, though it is to be appreciated that the brim 102 is optional and may be omitted in some examples. As shown, the brim 102 may be a full brim that extends continuously around an entire circumference of the crown 104. The brim 102 may have a width measured along a central axis (such as the axis 216 shown in FIG. 3) from an outer terminal edge of the brim 102 to the region where the brim 102 couples to the crown 104 that is the same width along the entirety of the brim 102. The width may be relatively short (e.g., 5-10 cm) or relatively wide (e.g., 10 cm or greater). Although illustrated and described as a hat having a brim that extends around an entirety of the hat, it is to be understood that brim 102 may be a partial brim that only extends from a front of the hat 100, and may not extend around an entirety of the crown 104. Any one or more of the features described herein may be included in any suitable style of hat such as a cap, a visor, etc.

A chin strap 108 may extend from the brim 102 and/or the crown 104. For example, the chin strap 108 may be integrated with and/or coupled/attached to a bottom surface 206 of the brim 102, an interior surface of the crown 104, or an intersection at which the brim and the crown meet, as shown in FIG. 3. Further, in some examples, the chin strap 108 may be removable and thus may be coupled to the crown 104 via hooks, snaps, or another suitable reversible fastener. As the brim and/or crown of the hat 100 forms a substantially circular or oval structure, the chin strap may be coupled and/or attached to the hat at two positions along a circumference of the crown and/or brim. For example, a first position or location at which the chin strap is coupled and/or attached to the hat may be directly opposite a second position or location at which the chin strap is coupled and/or attached to the hat. However, the locations where the chin strap 108 couples to the crown 104 are non-limiting and the chin strap 108 may be coupled to any location on the crown without departing from the scope of this disclosure.

The chin strap 108 may comprise a same material as used in another region of the hat, an elastomeric material, a fabric and/or self-fabric, a cord or a collection of cording, a string or collection of strings, lacing, an elastomeric and/or fabric yoke, and/or another suitable material or composite material. In some examples, the chin strap may include separate ear flaps that may removably couple to one another under the chin of the wearer. The chin strap 108 may include a single strap of material or two strap portions of material that are maintained separate or joined via a coupling mechanism. In the two strap portions example, each strap portion may include two terminal ends opposite one another along a longitudinal axis of the strap portion (e.g., along a length/longest dimension of the strap portion). A first terminal end of each strap portion may be coupled and/or attached to a different one of the two opposing locations along the circumference of the brim/crown. In the single strap example, the strap may include two terminal ends, each of which is coupled and/or attached to the above-described opposing locations along a circumference of the brim and/or crown. In still further examples, the chin strap 108 may be a yoke-style chin strap with each side of the chin strap splitting into two sub-portions that are configured to frame the ears of the wearer. In such examples, each side of the chin strap may include two terminal ends that are coupled to the crown, and thereby the chin strap may be coupled to the crown at four attachment points.

The chin strap 108 is configured to assist in maintaining the hat 100 on a head of a wearer. To provide this function, the chin strap 108 may be configured to be positioned under a chin of the wearer. In some examples, the chin strap may be positioned under the chin of the wearer via the shape and material properties of the chin strap, e.g., the chin strap may be comprised of an elastomeric material that stretches or contracts to fit under the chin of the wearer. In other examples, the chin strap may be positioned under the chin of the wearer via a knot formed with the two strap portions of the chin strap (e.g., similar to a shoe lace). In still further examples, the chin strap may be secured under the chin of the wearer via an adjustment mechanism (e.g., one or more snaps, clips, or a cord lock) that may be adjustable to tighten or loosen the chin strap. In any of the above examples, the chin strap 108 is configured to be held under the chin of the wearer with varying amounts of tension (e.g., tighter or looser), and in some examples, the chin strap may be decoupled/loosened to such an extent that the chin strap is not held under the chin of the wearer.

In the example shown in FIGS. 1-3, the chin strap 108 may include an adjustment mechanism 110 configured to tension (e.g., tighten or loosen) the chin strap 108 relative to the head of the wearer, for example by adjusting a vertical position where two sections of the strap are brought into proximity (e.g., in contact or within a threshold range of distances, such as within 0-3 mm). For example, the adjustment mechanism 110 may be an adjustable cord lock configured to be moved upward or downward when a release button is held by the wearer, or other suitable adjustment mechanism, such as a cord lock without a release button, an adjustable toggle, a clip, etc. The adjustment mechanism 110 may join two sections of the strap, such that a wearer may not be able to loosen the chin strap 108 without applying force to the adjustment mechanism 110, at least in some examples. However, in some examples, the adjustment mechanism 110 may be omitted.

A rear cape 112 may extend from the brim 102 and/or the crown 104 to protect a neck of a wearer. The rear cape 112 may be permanently attached to the crown and/or brim, in some examples. In other examples, the rear cape 112 may be removably attached to the crown and/or brim. The rear cape 112 may be configured with a thin and flexible material composition that is effective for providing camouflage, blocking UV rays, transferring heat away from the head and/or neck, resisting and/or repelling water, etc. In other examples, the rear cape may be comprised of an insulating material configured to retain heat around a neck of the wearer and/or repel wind and/or water. In still further examples, the rear cape may include a rear and/or side portions of the brim of the hat, when the brim is wider than the brim shown in FIGS. 1-3 (at least in a rear portion of the brim). For example, the separate rear cape may be dispensed with and the brim, at least in the rear portion and along the sides of the headwear, may extend outward to a greater extent than shown in FIGS. 1-3 (e.g., such that the brim, at the rear of the headwear, terminates at or below the top of the shoulders of the wearer). In still further examples, the rear cape may be take the form of two ear flaps, one on each side of the headwear. In this manner, the rear cape may refer to a portion (or portions) of the headwear that extends outward/downward from the crown in the rear and/or along the sides of the crown in order to provide sun, wind, rain, and/or cold protection to the neck and/or ears of the wearer. These and other features described in more detail below may be provided in various combinations of headwear embodiments to provide a robust, flexible, and functional rear cape.

For example, the rear cape 112 may be integrated with and/or coupled/attached to the bottom surface 206 of the brim 102, an interior surface of the crown 104, an intersection at which the brim and the crown meet, and/or any other suitable location. In the example shown herein (e.g., shown in FIG. 3), the rear cape 112 may be attached at the intersection at which the brim and the crown meet. Such a position of the rear cape 112 may allow the rear cape 112 to drape on or close to the neck of the wearer and may promote folding or otherwise stowing of the rear cape 112 into a pocket formed between edges of the brim, as will be described in more detail below with respect to FIG. 3. In some examples, the rear cape 112 may be removable, and thus may be coupled to the crown 104 via one or more snaps, buttons, zippers, etc.

FIG. 1 includes a vertical axis 111 as a reference axis. The vertical axis 111 may extend parallel to a direction of gravity. In some examples, the rear cape 112 may extend at an angle parallel to the vertical axis 111, draping downward from the crown 104 of hat 100. In other examples, as shown in FIG. 1, the shape of the rear cape (e.g., semi-circular) may cause the rear cape 112 to extend at an angle outward (e.g., away from the vertical axis 111) that is not parallel to the vertical axis 111, such as an angle in a range of 10-40 degrees. In some examples, the rear cape 112 may lack any additional structure (e.g., ribs, darts, or the like) such that when hat 100 is worn by a wearer, rear cape 112 may drape along the back of the wearer's head and neck, adhering to the angle of the wearer's neck. However, in other examples, the rear cape 112 may include darts or other structure.

The rear cape 112 may be formed from a single panel of material having an outer terminal edge 208 that forms the bottom edge and side edges of the rear cape 112 and an upper terminal edge (not visible) that is coupled and/or attached to the hat 100 at the crown 104. For example, the upper terminal edge may be coupled and/or attached to a junction on a headband 202 (shown in FIG. 3) that extends around an inner circumference of the crown 104. In some examples, the upper terminal edge may be sandwiched between an interior (e.g., crown-facing) surface of the headband 202 and an interior surface 204 of the crown 104 (also shown in FIG. 3). In other examples, the upper terminal edge may be directly coupled and/or attached to the interior surface 204 of the crown 104, the headband 202, and/or a bottom surface 206 of the brim 102 (shown in FIG. 3). However, in other examples, the rear cape 112 may be formed from two or more panels of material that are stitched or otherwise joined together. In such examples, the two or more panels may be joined to form the outer terminal edge 208 and the upper terminal edge.

As shown in FIG. 3, the outer terminal edge 208 may terminate on each side (e.g., a right side and a left side) at the upper terminal edge, forming a first terminating corner 210 and a second terminating corner 212. As the brim and/or headband of the hat 100 forms a substantially circular or oval structure, the first terminating corner 210 may be directly opposite the second terminating corner 212 (e.g., approximately 180 degrees or more separating the two locations/positions). In the example shown in FIGS. 1-3, the rear cape 112 may extend around more than half of the circumference of the crown 104, such that the first terminating corner 210 and the second terminating corner 212 are each positioned closer to a front of the hat than a rear of the hat. For example, each of the first terminating corner 210 and the second terminating corner 212 are positioned forward of a first central axis 214 of the hat 100 that bisects the hat at a center of the hat and extends from the left side to the right side of the hat. In the example shown in FIG. 3, the chin strap 108 may also couple to the crown/brim forward of the first central axis 214, with the first terminating corner 210 and the second terminating corner 212 are positioned forward of where the terminal edges of the strap(s) defining the chin strap 108 couple to the crown 104 and/or brim 102.

The rear cape 112 may be sized and shaped to provide desired coverage along the head and neck of the wearer of the hat 100. The rear cape may have a suitable length at a longest portion of the rear cape so that the rear cape terminates at or past the shoulders of the wearer, at least in some examples. The rear cape 112 may have a suitable shape, such as circular, triangular, oval, or another suitable shape.

As appreciated in FIG. 3, a length of rear cape 112, from the upper terminal edge to the outer terminal edge 208, at a center of the rear cape 112 (aligned with a center of hat 100 at a second central axis 216 that bisects the hat and extends from the front of the hat to the back of the hat), may be longer than a length of the brim 102, although other lengths are possible without departing from the scope of this disclosure. Rear cape 112 may be shaped (e.g., having a curved, semi-circular shape) such that the length of the rear cape gradually decreases from the center toward the terminating corners. When the rear cape 112 is positioned on a flat surface, as shown in FIG. 3, the outer terminal edge 208 may have an ellipsoid shape (except where the upper terminal edge is cut/shaped to match the curvature of the crown 104) with a major axis 302 and a semi-minor axis that is aligned with the second central axis 216 and extends from the major axis 302 to the outer terminal edge 208. In this way, when the rear cape 112 is draping on a wearer, rear cape 112 may not drape forward over a wearer's shoulders or neckline, ensuring rear cape 112 drapes on the back of a wearer's head and neck. In other examples, the rear cape 112 may have another suitable structure, such as triangular.

The shape of the rear cape 112 may provide for angling at the sides of the rear cape, from the crown toward a bottom portion of the rear cape, relative to a vertical axis, which may allow for the rear cape to cover the ears of the wearer without having the rear cape drape too far forward and touch or otherwise obscure aspects of the wearer's face. However, in other examples, the sides of the rear cape may angle forward rather than backward, or the sides of the rear cape may extend without angling (e.g., extend substantially straight and parallel to the vertical axis).

FIGS. 1-2 show the curvature and angling of the rear cape 112 when the hat 100 is in an upright position, as the hat 100 would appear when being worn. As shown in FIGS. 1-2, the outer terminal edge 208 may include a first region 208*a* (present on both the right and left side of the rear cape 112) that angles toward a rear of the hat 100, relative to the vertical axis 111. The first region 208*a* extends along an angle α1. The angle α1 may be 15 degrees, 30 degrees, or another suitable angle that is less than 90 degrees but more than 0 degrees, relative to the vertical axis 111. The outer terminal edge 208 may include a second region 208*b* (also present on both the right and left sides of the rear cape 112) that curves with a non-zero radius of curvature that is less than a radius of curvature of the first region 208*a*. The outer terminal edge 208 further includes a third region 208*c* along the bottom of the rear cape 112. The third region 208*c* may have a small curvature (as appreciated by FIG. 3) but may appear relatively straight relative to the curvature of the first region 208*a* and the second region 208*b* when the hat 100 is in the upright position. The third region 208*c* may be positioned intermediate the two second regions 208*b*, and each second region 208*b* may be positioned intermediate the third region 208*c* and a respective first region 208*a*. In this way, each second region 208*b* may act as a transitional region where the rear cape 112 switches from being angled (along the first regions 208*a*) to being substantially straight (along the third region 208*c*). The angling of the rear cape 112, and in particular the angling of the first regions 208*a*, may keep the rear cape 112 away from the wearer's face while still providing adequate sun protection to the ears and neck of the wearer.

In examples where the rear cape 112 is triangular or another non-ellipsoid shape, the first region 208*a* may angle as described above, but one or more of the second region 208*b* and third region 208*c* may be omitted or modified. For example, the second region 208*b* and third region 208*c* may be omitted and the two first regions 208*a* may angle toward each other and eventually meet and terminate at an apex that forms the bottom-most portion of the rear cape (e.g., when the rear cape is triangular).

It will be appreciated that rear cape 112 may be folded into a pocket formed between the bottom surface 206 of the brim 102 and an outer layer 218 that extends partially around the bottom surface 206 such that the headwear may be worn without the rear cape 112 draping behind a wearer's head and neck. In the example shown, the outer layer 218 may be fixed (e.g., stitched, glued, etc.) to the bottom surface 206 at front leading edges 114 of the outer layer 218 and around an outer circumference of the outer layer 218, and may not be fixed to the bottom surface 206 along an inner circumference of the outer layer 218, thereby forming an opening with which the pocket may be accessed.

In the example shown, the front leading edges 114 of the pocket (which are visible on both the upper and undersides of the brim, and thus are shown in FIGS. 1 and 3) may be angled at an angle α2 that is substantially similar to the angle α1 of the first regions 208*a* of the outer terminal edge 208 of the rear cape 112. For example, α2 may be equal to al or within 5-30 degrees of al. Further, as appreciated by FIG. 1, the slits 109 may also extend from the front of the crown toward a rear of the crown at an angle, and the angle of the slits 109 may be substantially similar to the angle α2. The similar angles of the sides of the rear cape 112 and the leading edges of the pocket may facilitate easier stowage of the rear cape in the pocket, promote ease in manufacture of the hat, and/or provide a cohesive visual appearance. It is to be appreciated that the angling of the cape relative to the angling of the leading edges and/or slits is exemplary and that other angles are possible without departing from the scope of this disclosure. For example, the rear cape and leading edges may extend at substantially different angles, or the pocket may be dispensed with and hence the hat may lack the leading edges.

In some examples, as shown in FIG. 2, the chin strap 108 may optionally include one or more anchor points to which one or more different components may be removably attached (where the one or more different components may include components of the hat 100 or separate components), such as the rear cape 112, a face mask, a balaclava, etc. As shown in FIG. 2, the chin strap 108 may optionally include a first set of anchor points (including one or more of anchor points 120*a*, 122*a*, and 124*a*) and a second set of anchor points (including one or more of anchor points 120*b* 122*b*, and 124*b*). The first set of anchor points may be positioned on a first strap portion 108*a* of the chin strap 108 and the second set of anchor points may be positioned on a second strap portion 108*b* of the chin strap 108.

The first and second sets of anchor points may comprise first portions of complementary fasteners, such as male or female portions of snaps, with corresponding, complementary second portions located on the rear cape 112, a face mask, a balaclava, or another component. For example, while not shown in FIG. 2, the rear cape 112 may include one or more complementary anchor points on each side of the rear cape. The first and second set of anchor points may comprise snaps, as mentioned above, or may comprise first portions of another suitable type or types of fastener, such as buttons (e.g., where the anchor points comprise the buttons and/or holes to accommodate a button), hook-and-loop fasteners, hook-and-eyelet fasteners, magnetic elements, etc. In some examples, the anchor points on the chin strap may comprise clips configured to couple to the rear cape via friction, and the rear cape may not include complementary fasteners.

The first and second sets of anchor points may be positioned on the chin strap 108 at suitable positions that may allow the rear cape 112 or another component to couple to the chin strap. Thus, the anchor points are all coupled to the chin strap below the attachment points where the chin strap couples to the crown. Further, at least some of the anchor points may be positioned at or below a first region of the chin strap that overlaps the ears of the wearer when the hat is worn. Some of the anchor points may be positioned below the ears, such as at a second region of the chin strap that overlaps the jaw of the wearer when the hat is worn and/or below the second region of the chin strap that overlaps the jaw of the wearer. In a non-limiting example, a first anchor point 120*a* of the first set of anchor points and a first anchor point 120*b* of the second set of anchor points may each be positioned at the first region, a second anchor point 122*a* of the first set of anchor points and a second anchor point 122*b* of the second set of anchor points may each be positioned at the second region, and a third anchor point 124*a* of the first set of anchor points and a third anchor point 124*b* of the second set of anchor points may each be positioned below the second region.

The first set of anchor points may be spaced apart from each other by equal amounts, or the first set of anchor points may be spaced apart from each other by unequal amounts. Similarly, the second set of anchor points may be spaced apart from each other by equal amounts, or the second set of anchor points may be spaced apart from each other by unequal amounts. In some examples, the first anchor point 120*a* may be positioned on the first strap portion 108*a* at a distance relative to the crown 104 that is the same distance from the crown 104 that the first anchor point 120*b* is positioned on the second strap portion 108*b*. The second anchor point 122*a* may be positioned on the first strap portion 108*a* at a distance relative to the crown 104 that is the same distance from the crown 104 that the second anchor point 122*b* is positioned on the second strap portion 108*b*. The third anchor point 124*a* may be positioned on the first strap portion 108*a* at a distance relative to the crown 104 that is the same distance from the crown 104 that the third anchor point 124*b* is positioned on the second strap portion 108*b*.

By providing more than one anchor point on each strap portion of the chin strap 108, the rear cape 112 and one or more other desired components (e.g., a balaclava) may be secured to the chin strap 108 at one time, or the rear cape 112 (or another component) may be secured to the chin strap 108 at varying positions, which may allow a wearer of the hat to select a position that best secures the rear cape to the chin strap, allows for desired ventilation, or provides another benefit. The anchor points shown in FIG. 2 may each be positioned on an outer side of the respective chin strap portions, that face away from a face of a wearer of the hat. Such a configuration may allow for the anchor points to be used to couple to the rear cape or another component. In some examples, the anchor points on either side of the chin strap may not be complementary to one another (e.g., the first anchor point 120*a* may not be complementary to the first anchor point 120*b*).

FIGS. 4-8 show another non-limiting example of the hat 100 including fasteners configured to removably couple the rear cape 112 to the chin strap 108. In particular, FIGS. 4-8 show an example implementation of the anchor points discussed above where each chin strap portion includes a fastener configured to couple to a complementary fastener on the rear cape. It is to be understood that the example shown in FIGS. 4-8 is non-limiting and that the fasteners could be configured differently than shown in FIGS. 4-8, as will be discussed in more detail below.

The fasteners may include a first set of fasteners 401 on a first side (e.g., on a left side) of the hat 100 and a second set of fasteners (not shown) on a second side (e.g., on a right side) of the hat 100. It will be appreciated that the second set of fasteners may be substantially similar to the first set of fasteners 401, and thus the below description of the first set of fasteners likewise applies to the second set of fasteners.

The first set of fasteners 401 includes a first fastener 402 directly attached to chin strap 108 and a second, complementary fastener 404 directly attached to the rear cape 112. The second fastener 404 may be positioned adjacent (e.g., within 1-5 mm) of the outer terminal edge 208 of the rear cape 112, or the second fastener 404 may be positioned away from the outer terminal edge 208 of the rear cape 112. The first and second fasteners 402 and 404 may be directly coupled together to couple the first side of the rear cape 112 to the chin strap 108. Similarly, the complementary fasteners of the second set of fasteners may be directly coupled together to couple the second side of the rear cape 112 to the chin strap 108. In doing so, the rear cape 112 may be coupled to the chin strap 108 in two opposing positions.

The first set of fasteners 401 (and likewise the second set of fasteners) may comprise a snap, with the first fastener 402 being the male portion of the snap and the second fastener 404 being the female portion of the fastener (or vice versa). However, in other examples, the first set of fasteners 401 may include any suitable type of fastener, such as hook-and-loop, buttons, hook-and-eyelet, etc. The first fastener 402 may have a coupling face 403 that is configured to be brought into face-sharing contact with a complementary coupling face 405 of the second fastener 404 (shown in FIG. 8) in order to couple the rear cape 112 to the chin strap 108. The first fastener 402 may be positioned on the chin strap 108 such that the coupling face 403 of the first fastener 402 is on an outer side 406 of the chin strap 108, opposite an inner side 408 of the chin strap 108. The inner side of the chin strap 108 may be configured to face the face and/or neck of a wearer of the hat 100. Likewise, the second fastener 404 may be positioned such that the coupling face 405 of the second fastener 404 is on an inner side 209 of the rear cape, opposite an outer side 211 of the rear cape 112.

The first fastener 402 may be positioned on the chin strap 108 a first distance D1 from a top terminating edge of the chin strap 108 where the chin strap 108 couples to the crown 104. The first distance D1 may such that the first fastener is positioned at or adjacent (e.g., within 1 cm) a jaw of a wearer of the hat. In one non-limiting example, the first fastener 402 may be positioned 10 cm from the top terminating edge of the chin strap 108. However, other distances are possible without departing from the scope of this disclosure, such as closer to the ear, above the ear, below the jaw, etc. In some examples, when the hat 100 is configured to be worn by a child, the distance D1 may be shorter, such as in a range of 5-8 cm or another suitable length. The second fastener 404 may be positioned on the rear cape 112 a second distance D2 from the upper terminal edge of the rear cape 112 and/or where the rear cape 112 couples to the crown 104 and/or brim 102. In the example shown herein, the second distance D2 may be the same distance as D1, shorter than the first distance D1, or longer than the first distance D1, such as 10.25 cm. By positioning the first fastener 402 and the second fastener 404 at the positions described herein, the rear cape 112 may be fastened to the chin strap 108 at approximately the jaw or under the jaw of the wearer, and the rear cape 112 may extend from the crown 104 and/or brim 102 to the chin strap 108 in a straight or an angled manner without any undue gaps or bunches, and without being pulled so taught as to place strain on the rear cape 112, the fasteners, and/or where the rear cape 112 couples to the crown 104 and/or brim 102. In doing so, the rear cape 112 may be prevented from flapping or otherwise moving due to wind or other forces. The relatively small gap between the wearer's face and the outer terminal edge 208 of the rear cape along the front of the rear cape, when the rear cape 112 is in the fastened state, may reduce the amount of air (e.g., wind) that may traverse through the gap, thereby lowering or preventing flapping of the rear cape 112.

Figure 5:
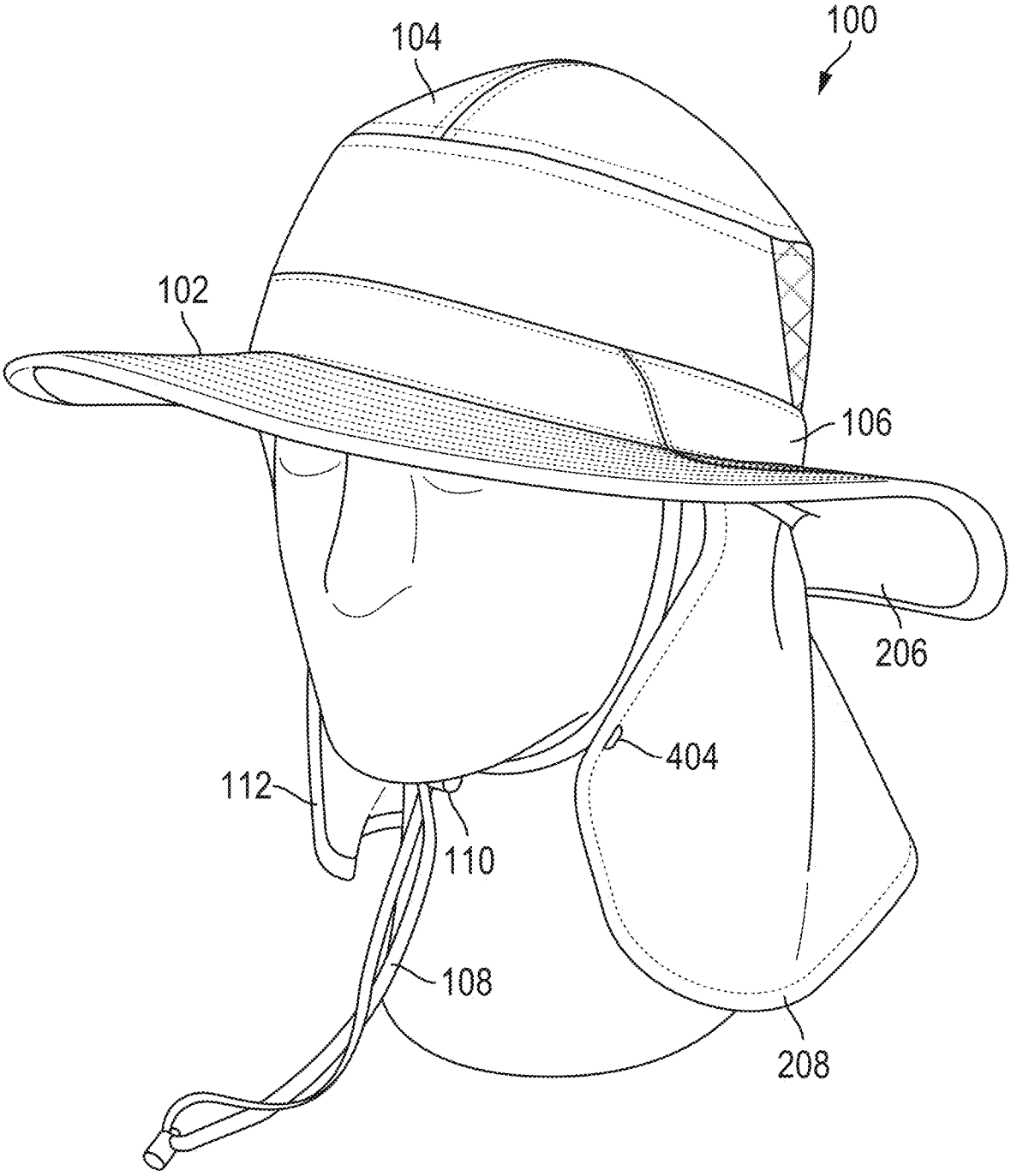
FIG. 5 shows a front view of the example headwear of FIG. 4 in a fastened state where fasteners on the rear cape are directly coupled to fasteners on the chin strap.

FIG. 5 shows the rear cape 112 in the fastened state such that when coupled, the inner sides of the rear cape 112 are removably fastened to chin strap 108 in a way that rear cape 112 does not bunch or form gaps along chin strap 108 between fasteners 402 and 404 and the bottom surface 206 of the brim 102. Whilst coupled, rear cape 112 may be positioned in a way along chin strap 108 that does not bring rear cape 112 in direct contact with a wearer's ears or face. When present, the wearer may adjust the tightness of chin strap 108 via adjustment mechanism 110 while rear cape 112 is fastened to chin strap 108 via fasteners 402 and 404 (e.g., by moving the adjustment mechanism 110 vertically upward), resulting in a downward force where chin strap 108 is directly attached to the crown 104 and/or brim 102 (e.g., in a direction parallel to gravity), as well as an angled force on rear cape 112 (e.g., angled inward toward the wearer's face) where rear cape 112 is attached to the crown 104 and/or brim 102. Thus, a single tightening motion of the adjustment mechanism 110 may act to simultaneously tighten both the chin strap 108 around the wearer's chin and the rear cape 112 around the sides of the wearer's face.

FIG. 5 shows the adjustment mechanism 110 in a first position where the adjustment mechanism 110 is in proximity to the chin of the wearer (e.g., touching or within a threshold distance of the chin, such as within 1-10 mm). When the adjustment mechanism is brought to the first positon, a tightening force acts on the chin strap and on the rear cape when the rear cape is coupled to the chin strap via the first set of fasteners and/or the second set of fasteners. The rear cape is also brought into proximity of the face of the wearer. If the adjustment mechanism is loosened to a second position that is spaced away from the chin (such as the position of the adjustment mechanism shown in FIG. 6), the tightening force may be reduced and the rear cape may be moved further away from the chin of the wearer. However, even when the chin strap is in the second position (or any other non-tight position where the adjustment mechanism is spaced away from the chin of the wearer), when the rear cape 112 is fastened to the chin strap 108, a flapping of the rear cape 112 may be reduced relative to when the rear cape 112 is not fastened to the chin strap 108.

Figure 6:
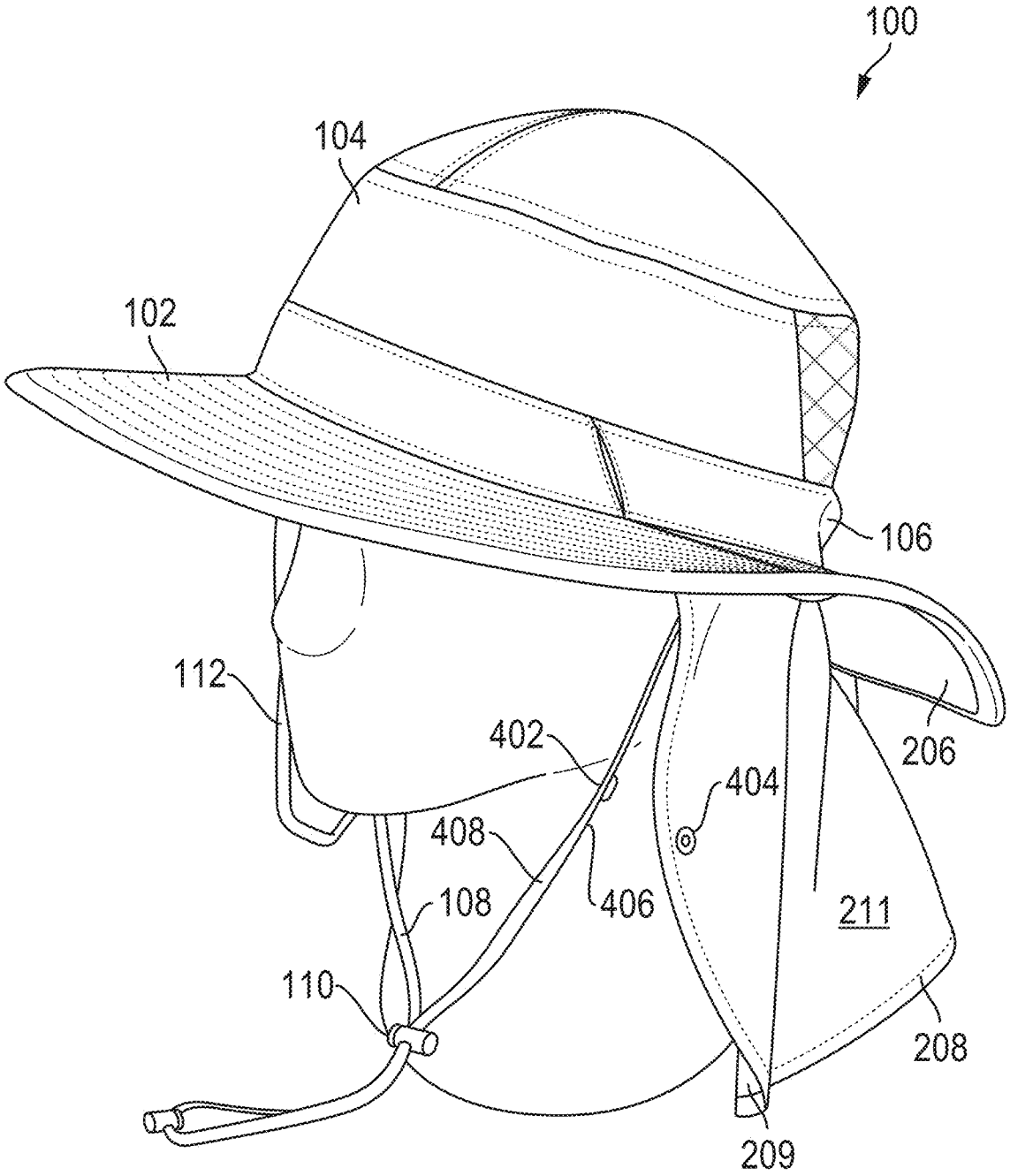
FIG. 6 shows a first side view of the example headwear of FIG. 4 in an unfastened state where the rear cape is not fastened to the chin strap.

As shown in FIG. 6, the fasteners may be released (e.g., uncoupled from each other) so that the rear cape 112 is not attached to the chin strap 108. By allowing the reversible coupling of the rear cape 112 to the chin strap 108, the rear cape 112 may be coupled to the chin strap 108 when air movement through the rear cape 112 is not desired, but then decoupled when air movement through the rear cape 112 is desired (e.g., to promote air movement over the wearer's neck).

As explained above, the second set of fasteners may be configured similarly as the first set of fasteners, such that the chin strap 108 includes an additional first fastener on the other side of the chin strap 108, and the rear cape 112 includes an additional second fastener on the other (e.g., right) side of the rear cape 112. The second set of fasteners is shown in FIGS. 7 and 8, including the third fastener 702 and the fourth fastener 704.

In some examples, the male/female members of the second set of fasteners may be opposite the first set of fasteners. For example, as explained above, the first fastener 402 may be a male portion of a snap and the second fastener 404 may be a female portion of the snap. The second set of fasteners may be configured so that the first fastener (on the chin strap) is a female portion and the second fastener (on the rear cape) is a male portion. In configuring the two sets of fasteners in such a manner, the fasteners on the rear cape 112 may be directly coupled together, when desired, which may provide an alternative mechanism for configuring the rear cape 112. Still other fasteners may be provided without departing from the scope of this disclosure, such as multiple sets of fasteners on each side of the chin strap and the rear cape, arranged vertically, which may accommodate coupling the rear cape to the chin strap at different distances along the chin strap (which may ensure that the rear cape can be secured to the chin strap under the jaw of the wearer regardless of the size of the wearer's head).

In some examples, rear cape 112 may be coupled to chin strap 108 without fasteners coupled to chin strap 108. Configuring the chin strap 108 so that the chin strap 108 lacks fasteners or other coupling hardware may improve the comfort of the wearer of the hat by placing rigid components such as fasteners further away from the face. Further, in examples where rear cape 112 is removed, no fasteners would be visible.

A non-limiting example of hat 100 with fasteners only on the rear cape 112 and not on the chin strap 108 is shown in FIGS. 9-10. Rear cape 112 may be configured to couple to chin strap 108 via a fastener 901 comprising a strap 902 coupled on a first end of strap 902 to rear cape 112 and having a first fastening portion 904 on a second end of strap 902, where the first fastening portion is configured to couple to a complementary second fastening portion 906 on rear cape 112. Strap 902 may be coupled at the first end to inner side 209 of rear cape 112 (not shown) and adjacent (e.g., within 1-5 mm) to the outer terminal edge 208 of the rear cape 112. Further, strap 902 may be coupled to rear cape 112 at a distance D2 (similar to the distance D2 of FIG. 4) from the upper terminal edge of the rear cape 112 and/or where the rear cape 112 couples to the crown 104 and/or brim 102. In some examples, strap 902 may be coupled to inner side 209 of rear cape 112 adjacent (e.g., within 1-5 mm) to second fastening portion 906. Other placements of second fastening portion 906 and strap 902 may be applied without departing from the scope of this disclosure. For example, strap 902 may be coupled to the outer terminal edge 208 of rear cape 112. As described above with respect to FIGS. 5-6, multiple fasteners may be provided. Further, while not shown in FIG. 9, it is to be appreciated that a second fastener may be positioned on a second side of the rear cape and may be similar to the fastener 901 described herein.

A second end of strap 902 opposite first end of strap 902 may be coupled to first fastening portion 904. As shown in FIG. 10, strap 902 may extend a length D3 past outer terminal edge 208 of rear cape 112. Length D3 may be such that strap 902 may wrap around chin strap 108 and allow first fastening portion 904 to couple with second fastening portion 906 as shown in FIG. 9. First fastening portion 904 and second fastening portion 906 may be oriented so that the coupling face of each is at the same side (e.g., both facing inner side 209 or both facing outer side 211 of rear cape 112) so that first fastening portion 904 may be coupled to second fastening portion 404 without twisting strap 902.

The fasteners on the rear cape shown in FIGS. 9 and 10 (e.g., the fastener 901) may be positioned similarly to the fasteners on the rear cape shown in FIGS. 4-8. For example, the fastener 901 may be positioned on a first leading edge of the rear cape (and likewise, the second fastener not shown in FIGS. 9 and 10 may be positioned on a second leading edge of the rear cape). As explained previously, the rear cape includes an outer terminal edge that terminates on a first side of the crown at a first terminating corner and on a second side of the crown at a second terminating corner, and each of the first terminating corner and second terminating corner may be positioned closer to a front of the crown than a rear of the crown. The outer terminal edge of the rear cape may angle relative to a vertical axis from the first terminating corner and the second terminating corner toward a bottom region of the rear cape, and the first and second leading edges may be the edges of the rear cape that angle as described herein and extend from the terminating corners to the bottom region. The chin strap may be coupled to the crown at a first attachment point and a second attachment point that are positioned between a central axis of the crown and the first terminating corner and second terminating corner, such that the first attachment point and second attachment point are each positioned closer to a rear of the crown than the first terminating corner and second terminating corner, at least in some examples.

In this way, rear cape 112 may be held along chin strap 108 as described above with respect to FIG. 5, but using only fasteners on the rear cape and without any fasteners directly coupled to chin strap 108. Other fasteners and straps which may hold rear cape 112 along but not directly coupled to chin strap 108 may be utilized without departing from the scope of this disclosure. For example, strap 902 may be a loop and second fastening portion 906 may be a button around which the loop may be secured, or strap 902 may be secured to the rear cape via a hook-and-loop type fastener. In other examples, strap 902 may not be present and second fastening portion 906 may be omitted, and a loop may instead be coupled to rear cape 112 or a slit may be present in rear cape 112 through which chin strap 108 may be fed before coupling chin strap 108 to the crown 104. As another example, strap 902 may not be present and second fastening portion 906 may be omitted and a clip (e.g., a slide-in clip) may instead be included on rear cape 112 that may secure rear cape 112 to chin strap 108 with tension.

While FIGS. 4-10 are described herein as being similar to the hat 100 shown in FIGS. 1-3, it is to be understood that the attachment of the rear cape to the chin strap provided via the sets of fasteners or other coupling mechanisms may be applied in other hats without departing from the scope of this disclosure. For example, the sets of fasteners may be included in a hat having a rear cape with a different shape or positioning than rear cape 112, in a hat that lacks a brim or a hat with a brim that does not fully encircle the crown (e.g., a cap with only a front brim), in a visor (e.g., where the crown does not fully cover the head of the wearer), etc.

For example, FIG. 11 shows another example headwear 1100 including a headband 1102 and a rear cape 1104 extending downward from the headband 1102. The headband 1102 may encircle a head of a wearer and may be comprised of a suitable material or layers of material. The headband 1102 may include elastic or other stretchable material to allow the headband 1102 to conform to a size of the wearer's head, and/or the headband 1102 may include an adjustment mechanism (e.g., snapback, cord with adjustable cord lock, etc.) to allow the wearer to adjust a size/circumference of the headband 1102. The headband 1102 may have a suitable height, such as one inch, two inches, etc. The rear cape 1104 may be similar to the rear cape 112 and may be permanently or removably coupled to the headband 1102 along a suitable location, such as a bottom surface of the headband 1102.

Headwear 1100 further includes a chin strap including a first strap portion 1106*a* and a second strap portion 1106*b* that may be brought into proximity and held into position with a tensioning mechanism, herein a cord lock 1107. For example, the cord lock 1107 may be toggled by the wearer to move the cord lock 1107 up or down, and once released, the cord lock 1107 may maintain the first strap portion 1106*a* and the second strap portion 1106*b* in position within the cord lock 1107 via friction. As shown, the first strap portion 1106*a* and the second strap portion 1106*b* are separate straps, but in some examples, the first strap portion 1106*a* and the second strap portion 1106*b* may be segments of the same, single strap. The first strap portion 1106*a* and the second strap portion 1106*b* are each coupled (either permanently or removably) to the headband 1102.

The rear cape 1104 includes anchor points to secure the rear cape 1104 to the chin strap. For example, the rear cape 1104 includes a first fastener 1110*a* and a second fastener 1110*b* each positioned along a leading edge of the rear cape 1104. The rear cape 1104 may include an outer terminal edge 1108 that forms a circumferential edge of the rear cape 1104 extends from the headband 1102 on a first side, across the rear cape, and to the headband 1102 on a second side. The leading edge of the rear cape 1104 may include the front-facing segments of the outer terminal edge 1108, e.g., the segments of the outer terminal edge 1108 that extend downward from the headband 1102 (until the rear cape curves and the outer terminal edge 1108 starts to extend horizontally towards a rear of the headwear). The first fastener 1110*a* may be positioned on a first side of the rear cape 1104 (e.g., on a right side) and the second fastener 1110*b* may be positioned on a second side of the rear cape 1104 (e.g., on a left side). The first fastener 1110*a* and the second fastener 1110*b* may be positioned at the same vertical distance from the headband 1102 and may be positioned similarly to the fasteners on the rear cape described above with respect to FIGS. 4-10. The first fastener 1110*a* and the second fastener 1110*b* may each comprise a strap with a snap that is complementary to a corresponding snap on the rear cape, similar to the fasteners described above with respect to FIGS. 9 and 10. However, other fastening mechanisms are possible without departing from the scope of this disclosure, such as clips, hook-and-loop fasteners, slits, etc.

As appreciated from FIG. 11, the chin strap does not include any fasteners or complementary fastening portions. The chin strap may be devoid of any tensioning or fastening hardware other than the cord lock 1107. The first fastener 1110*a* and the second fastener 1110*b* may be configured to secure the first strap portion 1106*a* and the second strap portion 1106*b*, respectively, of the chin strap to the rear cape 1104 without requiring complementary fasteners on the chin strap.

While FIG. 11 depicts the chin strap as being coupled to the headband 1102, in some examples the headwear 1100 may not include a chin strap. The headwear 1100 is configured so that the headwear 1100 may be worn with a separate, different piece of headwear, such as a cap or boonie. In examples where the separate, different headwear includes a chin strap, the first fastener 1110*a* and the second fastener 1110*b* may still be configured to secure the rear cape 1104 to the chin strap of the separate, different headwear.

Further, FIGS. 4-11 illustrate implementations that include only a single fastener on each strap portion of the chin strap or no fasteners on the chin strap, and only a single fastener on each side of the rear cape. However, more than one fastener may be provided on each strap portion of the chin strap and/or more than one fastener may be provided on each side of the rear cape. For example, shown in FIG. 2, two or three or more fasteners may be provided on each strap portion of the chin strap. In such examples, the rear cape may still include only one complementary fastener on each side of the rear cape, but the additional fasteners on the chin strap may allow for different configurations of how the rear cape is coupled to the chin strap, e.g., with larger or smaller gaps, closer or further from the bottom of the crown, etc. In other examples, the rear cape may additionally or alternatively include two or more fasteners, which may be aligned vertically in a similar manner to the multiple fasteners shown in FIG. 2, or positioned in a different manner. This configuration may allow for the rear cape to be coupled to the chin strap at more than one location (which may reduce ventilation but maintain the rear cape in a more stable location) or at varying locations (e.g., coupled closer or further from the crown). In doing so, desired ventilation may be provided and/or the rear cape may be more or less rigidly coupled to the chin strap.

The disclosure also provides support for a headwear comprising: a crown, a chin strap coupled to the crown, and a set of fasteners to which one or more different components are configured to removably attach, the set of fasteners including a first fastener positioned on a first strap portion of the chin strap and a second fastener positioned on a second strap portion of the chin strap. In a first example of the headwear, the headwear further comprises: a rear cape extending downward from the crown and encircling a portion of a perimeter of a bottom of the crown, and wherein the rear cape includes a third fastener, complementary to the first fastener, on a first side of the rear cape and a fourth fastener, complementary to the second fastener, on a second side of the rear cape. In a second example of the headwear, optionally including the first example, the chin strap includes a first terminating end and a second terminating end each coupled to the crown, the rear cape includes an upper terminal edge coupled to the crown, and wherein the first fastener is positioned on the chin strap at a first distance from the first terminating end and the third fastener is positioned on the rear cape at a second distance from the upper terminal edge, the second distance larger than the first distance. In a third example of the headwear, optionally including one or both of the first and second examples, the first fastener has a coupling face positioned on an outer side of the chin strap and the third fastener has a coupling face positioned on an inner side of the rear cape. In a fourth example of the headwear, optionally including one or more or each of the first through third examples, the chin strap includes an adjustment mechanism that is adjustable to tension the chin strap under a chin of a wearer of the headwear. In a fifth example of the headwear, optionally including one or more or each of the first through fourth examples, when the rear cape is attached to the chin strap via the third and fourth fasteners: a first adjustment of the adjustment mechanism to a first, tighter position causes the rear cape to be moved closer to a face of the wearer, and a second adjustment of the adjustment mechanism to a second, looser position causes the rear cape to be moved further from the face of the wearer. In a sixth example of the headwear, optionally including one or more or each of the first through fifth examples, the first fastener is positioned on the first strap portion below a first attachment point where the first strap portion couples to the crown and the second fastener is positioned on the second strap portion below a second attachment point where the second strap portion couples to the crown.

The disclosure also provides support for a headwear, comprising: a crown, a chin strap coupled to the crown, the chin strap having a first strap portion and a second strap portion, an adjustment mechanism coupled to the chin strap, a rear cape extending downward from the crown and encircling a portion of a perimeter of a bottom of the crown, the rear cape having a first side and a second side, a first set of fasteners including a first fastener positioned on the first strap portion and a second fastener positioned on the first side of the rear cape, the second fastener complementary to the first fastener, and a second set of fasteners including a third fastener positioned on the second strap portion and a fourth fastener positioned on the second side of the rear cape, the fourth fastener complementary to the third fastener, where the adjustment mechanism is configured to provide a tightening force to the chin strap and to the rear cape when the rear cape is coupled to the chin strap via the first set of fasteners and/or the second set of fasteners. In a first example of the headwear, the adjustment mechanism provides the tightening force when the adjustment mechanism is adjusted to a first position and wherein the tightening force is released when the adjustment mechanism is adjusted to a second position. In a second example of the headwear, optionally including the first example, the adjustment mechanism is configured to bring the first strap portion in proximity to the second strap portion, and wherein the first position includes the adjustment mechanism being positioned closer to a chin of a wearer of the headwear than the second position. In a third example of the headwear, optionally including one or both of the first and second examples, the adjustment mechanism is configured to provide the tightening force to the chin strap and to the rear cape simultaneously.

The disclosure also provides support for a headwear, comprising: a crown and a rear cape extending downward from the crown and including a first fastener on a first leading edge of the rear cape and a second fastener on a second leading edge of the rear cape. In a first example of the headwear, the headwear further includes a chin strap coupled to the crown, the chin strap having a first strap portion and a second strap portion, and where the first fastener is configured to removably couple the rear cape to the first strap portion and the second fastener is configured to removably couple the rear cape to the second strap portion. In a second example of the headwear, optionally including the first example, the headwear further includes an adjustment mechanism that is adjustable to tension the chin strap under a chin of a wearer of the headwear, and where when the rear cape is coupled to the chin strap via the first and second fasteners, the adjustment mechanism in a first position causes the rear cape to be positioned closer to a face of the wearer than when the adjustment mechanism is in a second position. In a third example of the headwear, optionally including one or both of the first and second examples, the adjustment mechanism is a cord lock configured to be moved vertically upward and downward along the chin strap. In a fourth example of the headwear, optionally including one or more or each of the first through third examples, the first position includes the adjustment mechanism being positioned proximate the chin of the wearer and the second position includes the adjustment mechanism being positioned away from the chin of the wearer. In a fifth example of the headwear, optionally including one or more or each of the first through fourth examples, the headwear further comprises: a brim extending outward from the crown, and wherein at least a portion of the brim is positioned vertically above the rear cape and the chin strap. In a sixth example of the headwear, optionally including one or more or each of the first through fifth examples, the rear cape and the chin strap each extend downward from the crown along a vertical axis. In a seventh example of the headwear, optionally including one or more or each of the first through sixth examples, the rear cape includes an outer terminal edge that terminates on a first side of the crown at a first terminating corner and on a second side of the crown at a second terminating corner, and where each of the first terminating corner and second terminating corner are positioned closer to a front of the crown than a rear of the crown. In an eighth example of the headwear, optionally including one or more or each of the first through seventh examples, the outer terminal edge angles relative to a vertical axis from the first terminating corner and the second terminating corner toward a bottom region of the rear cape. In a ninth example of the headwear, optionally including one or more or each of the first through eighth examples, the chin strap is coupled to the crown at a first attachment point and a second attachment point that are positioned between a central axis of the crown and the first terminating corner and second terminating corner, such that the first attachment point and second attachment point are each positioned closer to a rear of the crown than the first terminating corner and second terminating corner. In a tenth example of the headwear, optionally including one or more or each of the first through ninth examples, the rear cape is configured to removably couple to the chin strap on the first side via only the first fastener and not any fasteners on the chin strap, and on the second side via only the second fastener and not any fasteners on the chin strap. In an eleventh example of the headwear, optionally including one or more or each of the first through tenth examples, the rear cape is configured to removably couple to the chin strap on the first side via a first complementary fastener on the chin strap, and on the second side via a second complementary fastener on the chin strap.

This disclosure also provides support for a headwear comprising: a crown, a chin strap coupled to the crown, the chin strap configured to be held with varying amounts of tension under a chin of a wearer of the headwear, and a set of fasteners configured to selectively secure a component to the chin strap. In a first example of the headwear, the headwear further includes a rear cape extending downward from the crown, wherein the set of fasteners is configured to selectively secure the rear cape to the chin strap, and wherein the set of fasteners includes a first fastener positioned on a first leading edge of the rear cape and a second fastener positioned on a second leading edge of the rear cape. In a second example of the headwear, optionally including the first example, the set of fasteners includes a first fastener positioned on a first strap portion of the chin strap and a second fastener positioned on a second strap portion of the chin strap. In a third example of the headwear, optionally including one or both of the first and second examples, the chin strap further includes an adjustment mechanism adjustable to vary the amount of tension of the chin strap under the chin of the wearer.

The disclosure also provides support for a headwear comprising: a crown, and a rear cape extending downward from the crown to a bottom region of the rear cape, the rear cape including an outer terminal edge that terminates on a first side of the crown at a first terminating corner and on a second side of the crown at a second terminating corner, and where each of the first terminating corner and second terminating corner are positioned closer to a front of the crown than a rear of the crown. In a first example of the headwear, the outer terminal edge angles relative to a vertical axis from the first terminating corner and the second terminating corner toward a bottom region of the rear cape. In a second example of the headwear, optionally including the first example, the headwear further comprises: a chin strap coupled to the crown, wherein the chin strap is coupled to the crown at a first attachment point and a second attachment point that are positioned between a central axis of the crown and the first terminating corner and second terminating corner, such that the first attachment point and second attachment point are each positioned closer to a rear of the crown than the first terminating corner and second terminating corner. In a third example of the headwear, optionally including one or both of the first and second examples, the headwear further comprises: one or more anchor points positioned on the chin strap.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various structures and configurations, and other features, functions, acts, and/or properties disclosed herein, as well as any and all equivalents thereof.

The invention claimed is:

1. A headwear comprising:

a crown;

a rear cape extending downward from the crown and encircling a portion of a perimeter of a bottom of the crown;

a chin strap coupled to the crown, the chin strap including an adjustment mechanism that is adjustable to tension the chin strap under a chin of a wearer of the headwear, the adjustment mechanism including one or more snaps, clips, or a cord lock; and a set of fasteners including a first fastener positioned on a first strap portion of the chin strap, a second fastener positioned on a second strap portion of the chin strap, a third fastener, complementary to the first fastener, on the first side of the rear cape, and a fourth fastener, complementary to the second fastener, on the second side of the rear cape, wherein the chin strap includes a first terminating end and a second terminating end each coupled to the crown, the rear cape includes an upper terminal edge coupled to the crown, and wherein the first fastener is positioned on the chin strap at a first distance from the first terminating end and the third fastener is positioned on the rear cape at a second distance from the upper terminal edge, the second distance larger than the first distance.

2. The headwear of claim 1, wherein the first fastener has a coupling face positioned on an outer side of the chin strap and the third fastener has a coupling face positioned on an inner side of the rear cape.

3. The headwear of claim 1, wherein when the rear cape is attached to the chin strap via the third and fourth fasteners:

a first adjustment of the adjustment mechanism to a first, tighter position is configured to cause the rear cape to be moved closer to a face of the wearer, and a second adjustment of the adjustment mechanism to a second, looser position is configured to cause the rear cape to be moved further from the face of the wearer.

4. The headwear of claim 1, wherein the first fastener is positioned on the first strap portion below a first attachment point where the first strap portion couples to the crown and the second fastener is positioned on the second strap portion below a second attachment point where the second strap portion couples to the crown.

5. A headwear, comprising:

a crown; and a rear cape extending downward from the crown and including a first fastener on a first leading edge of the rear cape and a second fastener on a second leading edge of the rear cape, wherein the first leading edge of the rear cape extends, on a first side of the rear cape, from a first terminating corner at the crown to a bottom region of the rear cape at a first angle toward a rear of the headwear and the second leading edge extends, on a second side of the rear cape, from a second terminating corner at the crown to the bottom region of the rear cape at a second angle toward the rear of the headwear, and wherein the first leading edge terminates on a first side of the crown at the first terminating corner and the second leading edge terminates on a second side of the crown at the second terminating corner, where each of the first terminating corner and the second terminating corner are positioned closer to a front of the crown than a rear of the crown;

a chin strap coupled to the crown, the chin strap having a first strap portion and a second strap portion, and where the first fastener is configured to removably couple the rear cape to the first strap portion and the second fastener is configured to removably couple the rear cape to the second strap portion;

wherein the rear cape is configured to removably couple to the first strap portion of the chin strap via a first complementary fastener on the chin strap, and to the second strap portion of the chin strap via a second complementary fastener on the chin strap, wherein the chin strap includes a first terminating end and a second terminating end each coupled to the crown, and wherein the first complementary fastener is positioned on the chin strap at a first distance from the first terminating end and the first fastener is positioned on the first leading edge of the rear cape at a second distance from the first terminating corner, the second distance larger than the first distance.

6. The headwear of claim 5, further comprising an adjustment mechanism that is adjustable to tension the chin strap under a chin of a wearer of the headwear, and where when the rear cape is coupled to the chin strap via the first and second fasteners, the adjustment mechanism in a first position is configured to cause the rear cape to be positioned closer to a face of the wearer than when the adjustment mechanism is in a second position.

7. The headwear of claim 6, wherein the adjustment mechanism is a cord lock configured to be moved vertically upward and downward along the chin strap, and wherein the first position includes the adjustment mechanism configured to be positioned proximate the chin of the wearer and the second position includes the adjustment mechanism configured to be positioned away from the chin of the wearer.

8. The headwear of claim 5, further comprising a brim extending outward from the crown, and wherein at least a portion of the brim is positioned vertically above the rear cape and the chin strap.

9. The headwear of claim 5, wherein the rear cape and the chin strap each extend downward from the crown along a vertical axis.

10. The headwear of claim 5, wherein the chin strap is coupled to the crown at a first attachment point and a second attachment point that are positioned between a central axis of the crown and the first terminating corner and second terminating corner, such that the first attachment point and second attachment point are each positioned closer to a rear of the crown than the first terminating corner and second terminating corner.

11. The headwear of claim 5, wherein the rear cape is configured to removably couple to the first strap portion of the chin strap via only the first fastener and not any fasteners on the chin strap, and to the second strap portion of the chin strap via only the second fastener and not any fasteners on the chin strap.

12. A headwear comprising:

a crown;

a rear cape extending downward from the crown and encircling a portion of a perimeter of a bottom of the crown;

a chin strap coupled to the crown, the chin strap configured to be held with varying amounts of tension under a chin of a wearer of the headwear; and a set of fasteners configured to selectively secure the rear cape to the chin strap, the set of fasteners including a first fastener positioned on a first strap portion of the chin strap and a second fastener, complementary to the first fastener, on a first side of the rear cape, wherein the chin strap includes a first terminating end coupled to the crown, the rear cape includes an upper terminal edge coupled to the crown, and wherein the first fastener is positioned on the chin strap at a first distance from the first terminating end and the second fastener is positioned on the rear cape at a second distance from the upper terminal edge, the second distance different than the first distance.

13. The headwear of claim 12, wherein the set of fasteners further includes a third fastener positioned on a second strap portion of the chin strap and a fourth fastener, complementary to the third fastener, on a second side of the rear cape, wherein the chin strap includes a second terminating end coupled to the crown, and wherein the third fastener is positioned on the chin strap at the first distance from the second terminating end and the fourth fastener is positioned on the rear cape at the second distance from the upper terminal edge, the second distance different than the first distance.

14. The headwear of claim 12, wherein the second distance is larger than the first distance.

* * * * *